United States Patent [19]

Zantiotis

[11] Patent Number: 4,628,642

[45] Date of Patent: Dec. 16, 1986

[54] DEVICE FOR SHARPENING CIRCULAR KNIVES

[76] Inventor: Jean Zantiotis, Taunusstrasse 45, D-6000 Frankfurt am Main, Fed. Rep. of Germany

[21] Appl. No.: 719,496

[22] Filed: Apr. 4, 1985

[30] Foreign Application Priority Data

Apr. 7, 1984 [DE] Fed. Rep. of Germany ... 8410918[U]

[51] Int. Cl.[4] ..... B24B 23/08

[52] U.S. Cl. ..... 51/248; 83/174; 51/50 R; 51/165.82

[58] Field of Search ..... 51/247, 246, 241 R, 51/248, 165.82, 165.86, 126, 51, 67; 83/174, 174.1

[56] References Cited

U.S. PATENT DOCUMENTS

| | | | |
|---|---|---|---|
| 1,551,167 | 8/1925 | Orlow | 51/247 X |
| 1,884,924 | 10/1932 | Van Berkel | 51/248 |
| 2,613,484 | 10/1952 | Soderman | 51/125 |

FOREIGN PATENT DOCUMENTS

| | | |
|---|---|---|
| 530535 | 12/1940 | United Kingdom . |
| 743962 | 2/1955 | United Kingdom . |
| 855500 | 5/1958 | United Kingdom . |
| 900154 | 4/1959 | United Kingdom . |
| 1195869 | 10/1968 | United Kingdom . |
| 2012633 | 8/1979 | United Kingdom . |
| 2021452 | 12/1979 | United Kingdom . |
| 2091144 | 7/1982 | United Kingdom . |

*Primary Examiner*—Robert P. Olszewski
*Assistant Examiner*—Maurina Rachuba
*Attorney, Agent, or Firm*—W. G. Fasse; D. H. Kane, Jr.

[57] ABSTRACT

A knife sharpening device has a slide (8) which carries freely rotatable grinding wheels or disks (11, 12). The slide is adjustable along a bar (5) of a frame (1, 2). The slide is fixed against lateral displacement in an adjusted operating or rather grinding position by the engagement of a pin (17) with a toothed rack (6). The grinding disk or disks are preferably driven by the positive rotation of the knives being sharpened. A slight vertical movement of the grinding disks is possible due to a respective play in the vertical direction.

12 Claims, 2 Drawing Figures

5
6
4
8a
8
13
9
17
15
11
16
7
12
14
10
3
II
18
II
6
1
6'
2

6
2
15
8
5
7
12
17
4
10
3
16
1'
1

DEVICE FOR SHARPENING CIRCULAR KNIVES

FIELD OF THE INVENTION

The invention relates to a device for sharpening circular knives, especially of knives having the same diameter and forming a set of knives held clamped on a common rotatable drive shaft. However, the device may also be used for sharpening circular knives having different diameters.

BACKGROUND OF THE INVENTION

Circular knives of this type are very thin, comparable to razor blades having a thickness of about 0.1 mm to about 0.4 mm. Such knives are all secured to a positively driven common drive shaft at predetermined spacings from knife to knife for cutting flat sheet material into narrow strips having widths in the millimeter range. More specifically, on such an apparatus sheets of leather are cut into fine leather strips. These knives must have a certain sharpness during a cutting operation for assuring a smooth cut of all strips. However, the knives can get dull quickly and it used to be quite cumbersome to sharpen these knives heretofore, because it is not unusual to have a substantial number of knives on one drive shaft, for example fifty knives on the same drive shaft. Thus, it would be desirable to be able to sharpen these knives even during a cutting operation, without the need of removing the knives or the set of knives out of the cutting apparatus.

OBJECTS OF THE INVENTION

In view of the above it is the aim of the invention to achieve the following objects singly or in combination:

to provide a sharpening apparatus for knives of the above type which can be used during a cutting operation;

to drive a sharpening disk by the rotation of the rotary knife being sharpened;

to provide a multiple adjustability for the position of the sharpening apparatus for bringing the grinding disk into the proper position relative to the blades to be sharpened without removing these rotary blades from the cutting apparatus; and to provide a sharpening device, which is as simple as possible in its structure and which can be used universally for sharpening all kinds of rotary knives and which further can easily be mounted to the cutting apparatus itself.

SUMMARY OF THE INVENTION

According to the invention, a device for sharpening circular knives, which are secured to a drive shaft for rotation, comprises a main frame for slidably guiding a slide, which is movable essentially horizontally and longitudinally along the main frame. The slide carries at least one grinding wheel. An engagement rail which interacts with an engagement element on the slide in the manner of a pawl, is fastened to the main frame for fixing the slide position.

BRIEF DESCRIPTION OF THE DRAWINGS

In order that the invention may be clearly understood, it will now be described, by way of example, with reference to the accompanying drawings, wherein.

Figure 1:
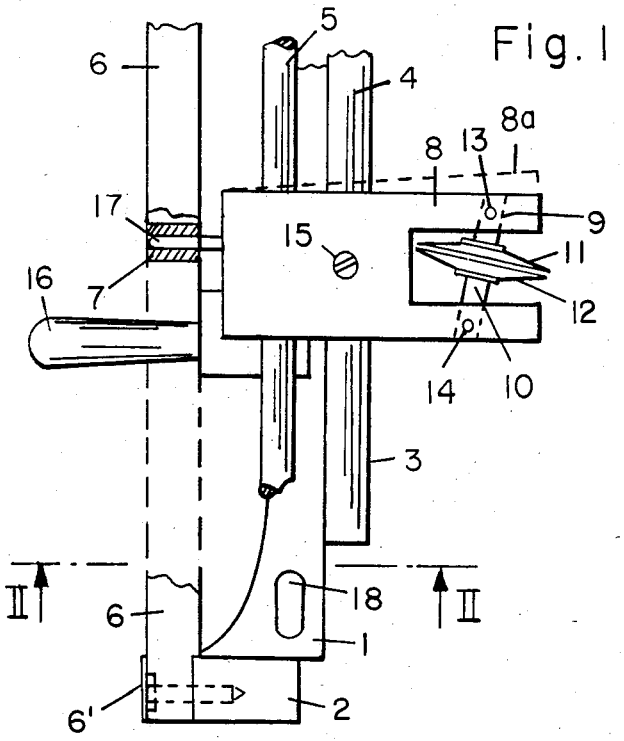
FIG. 1 is a partial plan view with some parts being cut away for the sake of clarity.

DETAILED DESCRIPTION OF PREFERRED EXAMPLE EMBODIMENTS AND OF THE BEST MODE OF THE INVENTION

The illustrated device comprises a main frame 1 in the form of an angle rail 1' and two raised bearing blocks 2 one of which is fastened to each end of the rail 1'.

The angle rail 1', which mainly serves as a stop for a ratchet type of operation and for fastening to a work table, has a projecting member 3, on which a surface-ground supporting face 4 is formed for providing a reference plane.

A guide bar 5 is arranged between the blocks 2 in parallel to the angle rail 1'. An engagement rail 6 is releasably fastened to the blocks 2. This engagement rail 6 is formed as a rack with teeth 7 pointing downwardly for a ratchet type operation to be described below. The teeth 7 have a very precise division, which is preferably in the range of 4 to 10 mm for stopping the grinding device in any desired position along the rail 6. The engagement rail 6 is fastened releasably by screws 6' to the blocks 2 so that the rail 6 can be exchanged for another rail with a different division. The division will depend on the spacing between the knives secured to a common drive shaft. A slide 8 is slidably mounted on a cylindrical guide bar 5 and can tilt about this guide bar 5 which is secured at its ends to the blocks 2.

The right-hand end of the slide 8 has a fork-shaped configuration. Two shafts 9 and 10 are mounted in line with each other in the fork legs. Each shaft 9, 10 carries rotatably a conical grinding wheel or disk 11 and 12 respectively. The distance between the facing surfaces of the two grinding wheels located opposite one another can be varied by adjustment of the shafts 9 and 10 in the longitudinal axial direction of the shafts 9, 10. Set screws 13 and 14 respectively are provided for fixing the shafts in position after the spacing has been adjusted.

The horizontally displaceable slide 8 carries a set screw 15, the point of which rests on the supporting face 4. The relative height of the slide can consequently be set as a result of adjustment of this set screw 15. Adjustment of the set screw 15 rotates the slide 8 about the guide bar 5 and relative to the reference plane.

The rear end of the slide 8 carries a handle 16 and an engagement element in the form of a pin 17 which engages in the toothing of the engagement rail 6 as soon as the slide is lowered into the position of rest shown in the drawings. When the handle 16 is pressed down or counterclockwise, the forked end of the slide is raised and the pin 17 is lifted out of the toothing. After the slide has been displaced horizontally into the desired position opposite the next knife to be sharpened, the slide 8 is returned to its new position when the handle 16 is raised, and the pin 17 engages into the desired tooth gap of the engagement rail 6.

The main frame 1 can be fastened to a work bench, preferably to the table of a cutting machine, and adjusted in its longitudinal direction. For this purpose the angle rail 1' is provided with longitudinal slots 18 extending in parallel to the guide bar 5.

Figure 2:
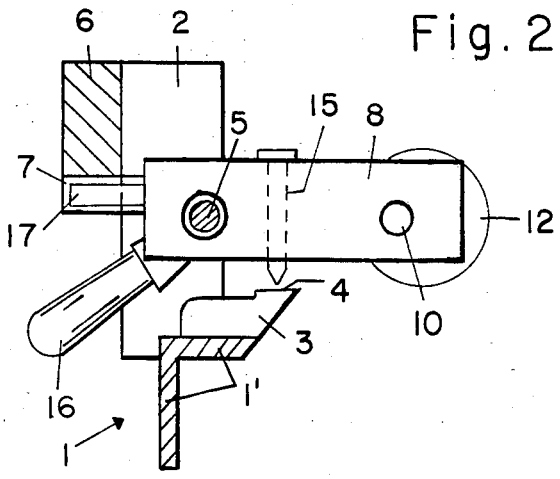
FIG. 2 is a section taken on the line II—II in FIG. 1.

As shown in FIG. 2, the shafts 9 and 10 lie in the same plane as the guide bar 5. However, as shown in FIG. 1 the shafts extend at an acute angle relative to the guide bar 5 for positioning the disks 11, 12 at the angle required for the grinding.

Depending on the construction of the cutting machine, the knives of which are to be sharpened, the slide 8 itself can diverge somewhat from the illustrated position at right angles to the guide bar 5, as shown diagrammatically by broken lines 8*a* in FIG. 1. In that case the hole through the slide 8 for the guide bar 5 would extend at the desired angle.

A sharpening device according to the invention can be used to sharpen knives of various diameters. It can be attached directly to a cutting machine in which the cutting knives are mounted or else can cooperate with a suitable mounting mechanism for the circular knives which have been removed from the cutting machine as a unit on a common drive shaft rather than individually.

For a grinding operation an operator holding the handle 16 lowers the disks 11, 12 toward a circular knife located below the disks 11, 12. The screw 15 which has been previously adjusted makes sure that the lowering of the grinding disks is precisely limited to only, for example about 0.5 to 1.5 mm, so that only the cutting edge of a knife enters slightly into the gap between the two grinding disks 11, 12. There is sufficient vertical play for the locking pin 17 between the teeth 7 to permit this slight lowering of the grinding disks while simultaneously precisely locking the slide 8 against lateral movement. Due to their small thickness the knives to be sharpened are sufficiently flexible so that with the angular position of the disks 11, 12 both knife edge surfaces near the circumference of the knives can be ground simultaneously. The extent of the grinding radially inwardly of a circular knife is also within the range of about 0.5 to 1.5 mm.

Where thicker, non-flexible knives are to be sharpened the shafts 9, 10 will extend in parallel to the guide bar 5 and it is possible to move the two disks 11, 12 into a spacing between two adjacent knives whereby the conical outer surfaces of the disks 11, 12 may grind simultaneously one knife edge surface of the cutting edges of two neighboring knives.

It may be possible to keep the grinding disks stationary. However, a gentler grinding is achieved when the rotation of the knife or knives being ground entrains the grinding disks.

Although the invention has been described with reference to specific example embodiments, it will be appreciated, that it is intended to cover all modifications and equivalents within the scope of the appended claims.

What I claim is:

1. A device for sharpening circular knives while these knives are mounted on a driven shaft, comprising longitudinal frame means, guide means mounted on said frame means for defining a guide direction, slide means slidably mounted for a back and forth movement along said guide means, two symmetrical grinding disks for grinding said knives, two shafts arranged in axial alignment with each other for rotatably mounting said grinding disks on said slide means, whereby each shaft supports its respective grinding disk for rotation, ratchet type elongated engagement means mounted on said frame means, and pawl type stop means mounted on said slide means for locking said slide means into any one of a plurality of fixed positions along said elongated engagement means, said two axially aligned shafts holding said two grinding disks spaced from each other and in such a position that two knife edge surfaces can be ground simultaneously.

2. The device of claim 1, wherein said guide means comprise a guide bar mounted in said frame means, said slide means comprising means for mounting said slide means on said guide bar for back and forth movement along said guide bar, said means for mounting said slide means to said guide bar also permitting tilting said slide means in a vertical plane relative the said guide bar.

3. The device of claim 1, wherein said two shafts are secured to said slide means for rotatably supporting said grinding disks at an angle relative to said guide direction and relative to said longitudinal frame means.

4. The device of claim 3, wherein said guide means comprise a guide bar mounted in said frame means, mounting means mounting said slide means on said guide bar for axially displacing said slide means along said guide bar and wherein said two drive shafts for said two grinding disks are located in a horizontal plane through said guide bar and through said shaft means.

5. The device of claim 3, further comprising means for mounting said two shafts on said slide means for an axial adjustment of at least one of said two shafts on said slide means for adjusting a spacing between said two grinding disks.

6. The device of claim 1, further comprising releasable securing means for securing said elongated engagement means in an exchangeable manner to said frame means.

7. The device of claim 1, further comprising a reference plane as part of said frame means, screw means extending through said slide means and bearing against said reference plane for adjusting the elevational position of said slide means relative to said frame means and thus also the elevational position of said two grinding disks.

8. The device of claim 1, wherein said frame means comprise slots for securing said frame means to a support.

9. The device of claim 1, wherein said slide means extend at a slant relative to the longitudinal frame means.

10. The device of claim 1, wherein each of said two grinding disks is mounted on its respective shaft for freely rotating on its shaft in response to contact with a knife to be ground.

11. The device of claim 1, wherein said two knife edge surfaces are formed by two neighboring circular knives mounted on said driven shaft.

12. The device of claim 1, wherein said two knife edge surfaces are formed near the circumference of each circular knife so that both knife edge surfaces of the same knife can be ground simultaneously.

* * * * *